US007701401B2

(12) United States Patent
Suzuki et al.

(10) Patent No.: US 7,701,401 B2
(45) Date of Patent: Apr. 20, 2010

(54) ANTENNA DEVICE HAVING NO LESS THAN TWO ANTENNA ELEMENTS

(75) Inventors: Hiromichi Suzuki, Tokyo (JP); Satoshi Mizoguchi, Tokyo (JP); Isao Ohba, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 174 days.

(21) Appl. No.: 11/975,332

(22) Filed: Oct. 18, 2007

(65) Prior Publication Data

US 2009/0009401 A1 Jan. 8, 2009

(30) Foreign Application Priority Data

Jul. 4, 2007 (JP) ..... 2007-176503

(51) Int. Cl.
*H01Q 1/24* (2006.01)

(52) U.S. Cl. ..... 343/702

(58) Field of Classification Search ..... 343/702, 343/700 MS, 846–848, 767
See application file for complete search history.

(56) References Cited

U.S. PATENT DOCUMENTS

| | | | | |
|---|---|---|---|---|
| 6,339,402 | B1 * | 1/2002 | McKivergan | 343/702 |
| 6,850,196 | B2 * | 2/2005 | Wong et al. | 343/702 |
| 6,914,565 | B2 * | 7/2005 | Shikata et al. | 343/700 MS |
| 7,289,064 | B2 * | 10/2007 | Cheng | 343/700 MS |
| 7,477,201 | B1 * | 1/2009 | Bit-Babik et al. | 343/702 |
| 2004/0212542 | A1 * | 10/2004 | Rahim | 343/742 |
| 2006/0044196 | A1 * | 3/2006 | Grant et al. | 343/713 |
| 2007/0182651 | A1 * | 8/2007 | Grant et al. | 343/713 |
| 2008/0094303 | A1 * | 4/2008 | Tseng et al. | 343/848 |

FOREIGN PATENT DOCUMENTS

| | | | |
|---|---|---|---|
| JP | 2003-332840 | A | 11/2003 |
| JP | 2005-033736 | A | 2/2005 |
| JP | 2005-198245 | A | 7/2005 |
| JP | 2006-203446 | A | 8/2006 |
| JP | 2006-332792 | A | 12/2006 |
| JP | 2007-088975 | A | 4/2007 |

OTHER PUBLICATIONS

Japanese Office Action dated Oct. 31, 2008 and English translation thereof issued in a counterpart Japanese Application.

* cited by examiner

*Primary Examiner*—Huedung Mancuso
(74) *Attorney, Agent, or Firm*—Frishauf, Holtz, Goodman & Chick, P.C.

(57) ABSTRACT

An antenna device provided in a radio apparatus having a printed circuit board includes a first antenna element and a second antenna element. The first antenna element is configured to be fed and grounded at a first feed portion and at a first short-circuit portion both on the printed circuit board, respectively. The second antenna element is configured to be fed and grounded at a second feed portion and at a second short-circuit portion both on the printed circuit board, respectively. The second feed portion is located farther from the first feed portion than from the first short-circuit portion, farther than the first short-circuit portion is from the first feed portion, farther from the first short-circuit portion than from the second short-circuit portion, and farther than the second short-circuit portion is from the first short-circuit portion.

12 Claims, 6 Drawing Sheets

ANTENNA DEVICE HAVING NO LESS THAN TWO ANTENNA ELEMENTS

CROSS REFERENCE TO RELATED APPLICATIONS

This application is based upon and claims the benefit of priority from the prior Japanese Patent Application No. 2007-176503 filed on Jul. 4, 2007; the entire contents of which are incorporated herein by reference.

BACKGROUND OF THE INVENTION

1. Field of the Invention

The present invention relates to an antenna device, and in particular to an antenna device having no less than two antenna elements.

2. Description of the Related Art

There is a trend that radio apparatus like mobile phones are equipped with not only so called a cellular-type mobile communication system but also various kinds of radio systems such as a wireless local area network (WLAN), the global positioning system (GPS), a radio identification system (RFID), a terrestrial digital television system and so on. It is anticipated that the above trend continues to grow, and that the radio apparatus will increasingly have multiple uses and multiple functions.

In response to advances in multiple uses and multiple functions of the radio apparatus, features of multiple resonance and broader frequency ranges are increasingly required of antenna devices provided in the radio apparatus. Meanwhile, downsizing and compactness are also required of the antenna devices from a viewpoint of improvement of designs and downsizing of the radio apparatus. In order to meet the above requirements conflicting to each other, the radio apparatus has to be equipped with an antenna device adapted for plural radio systems.

Configuration of such an antenna device may be divided broadly into two types of approaches. One of the approaches is a configuration where plural antenna elements (maybe including a parasitic element) having different resonant frequencies one another are combined, commonly fed by and distributed to plural systems via an antenna sharing device such as a switch or a duplexer.

Another one of the approaches is a configuration where plural antennas are arranged close to each other in a space-efficient manner, and each of the antennas is separately fed by an associated system.

In the configuration using the antenna sharing device, an isolation characteristic of the antenna sharing device dominates isolation among the systems different one another. In order to compensate for shortage of the isolation of the antenna sharing device, another device such as a band-pass filter may be needed. Consequently, increased insertion losses of the antenna sharing device and the filter may cause basic performance such as transmitter power or receiver sensitivity to be degraded.

The configuration where each of plural antennas is separately fed by an associated system is advantageous to basic performance of radio apparatus, as there is no need to think of insertion losses of antenna sharing devices and filters. Meanwhile, there is a problem that isolation may hardly be assured as the antennas are arranged spatially close one another.

For such a problem, conventional antenna devices have been proposed so that isolation may be assured, as disclosed in Japanese Patent Publication of Unexamined Application (Kokai), No. 2003-332840 and No. 2005-198245.

More specifically, the invention of the antenna device disclosed in JP 2003-332840 was applied by the applicant of this application so as to reduce a cross coupling between antennas of an antenna device arranged on a same grounded conductive plate and to reduce leakage of electromagnetic waves from a transmitting antenna to a receiving antenna. The antenna device is provided with a plate-like short-circuiting element on and almost perpendicular to the grounded conductive plate between feed portions of the antennas, and configured to block views between the feed portions for solving the above problems.

The antenna device disclosed in JP 2005-198245 is configured that one of two antenna elements is a half wavelength long with a grounded end so as to work equivalently to a loop antenna of a wavelength long and to suppress resonance occurring on a ground plane. It is mentioned that even if another one of the antenna elements is excited at a nearby frequency, a coupling between the antenna elements may be suppressed as antenna current distribution is small near a feed portion of the equivalent loop antenna.

The antenna device disclosed in JP 2003-332840 by the applicant of this application is configured to have the plate-like short-circuiting element perpendicular to the grounded conductive plate so as to isolate between the antennas. Such a configuration may not be very suitable for a small sized radio apparatus such as a mobile phone which is required to be small and thin.

The antenna device disclosed in JP 2005-198245 is on an assumption that frequency bands of use of the antenna elements are close to each other. It is thus restricted to apply such a configuration to broad multiple uses and multiple functions of radio apparatus.

SUMMARY OF THE INVENTION

Accordingly, an object of the present invention is to provide an antenna device including plural antenna elements and configured to assure isolation among the antenna elements to be ready for broad multiple uses and multiple functions of radio apparatus.

To achieve the above object, according to one aspect of the present invention, an antenna device provided in a radio apparatus having a printed circuit board includes a first antenna element and a second antenna element. The first antenna element is configured to be fed at a first feed portion provided on the printed circuit board. The first antenna element is configured to be grounded at a first short-circuit portion provided on the printed circuit board. The second antenna element is configured to be fed at a second feed portion provided on the printed circuit board. The second antenna element is configured to be grounded at a second short-circuit portion provided on the printed circuit board. The second feed portion is located farther from the first feed portion than from the first short-circuit portion, farther than the first short-circuit portion is from the first feed portion, farther from the first short-circuit portion than from the second short-circuit portion, and farther than the second short-circuit portion is from the first short-circuit portion.

BRIEF DESCRIPTION OF THE DRAWINGS

FIG. 14 is a line chart of isolation vs. frequency characteristic of the antenna device of the third embodiment estimated by simulation in comparison with characteristics of the antenna device of the second embodiment and so on.

DETAILED DESCRIPTION OF THE INVENTION

Figure 1:
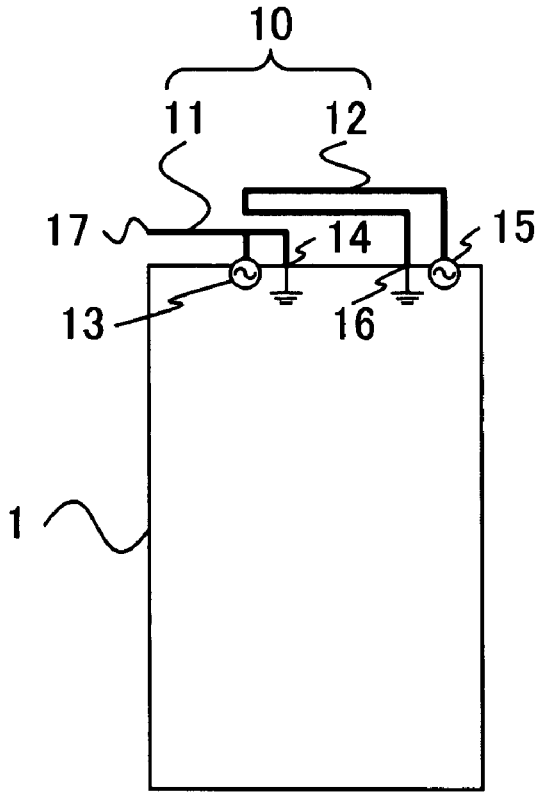
FIG. 1 is a plan view of members including an antenna device of a first embodiment of the present invention, having a first antenna element and a second antenna element.

Hereinafter, embodiments of the present invention will be described in detail. In following descriptions, terms like upper, lower, left, right, horizontal or vertical used while referring to a drawing shall be interpreted on a page of the drawing unless otherwise noted. Besides, a same reference numeral given in no less than two drawings shall represent a same member or a same portion.

A first embodiment of the present invention will be described with reference to FIGS. 1-3. FIG. 1 is a plan view of members including an antenna device 10 of the first embodiment to show a configuration of and around the antenna device 10. The antenna device 10 is arranged near an upper side of a printed circuit board (PCB) 1 included in a radio apparatus which is not shown.

The antenna device 10 has a first antenna element 11 and a second antenna element 12. The PCB 1 may be formed not only by a single board but by plural boards.

The first antenna element 11 is configured to be fed at a first feed portion 13 provided on the PCB 1 and is short-circuited to a ground circuit of the PCB 1 at a first short-circuit portion 14 provided on the PCB 1 so as to be grounded. The first antenna element 11 has a tip which is an open end 17.

The second antenna element 12 is configured to be fed at a second feed portion 15 provided on the PCB 1 and is short-circuited to the ground circuit of the PCB 1 at a second short-circuit portion 16 provided on the PCB 1 so as to be grounded.

The antenna device 10 has two features of configuration for improving isolation between the first antenna element 11 and the second antenna element 12. A first one of the features is that the first antenna element 11 and the second antenna element 12 are grounded at the first short-circuit portion 14 and the second short-circuit portion 16, respectively.

The above first feature may produce an effect that the isolation may be improved in comparison with a case where the first antenna element 11 or the second antenna element 12 were of an open-ended monopole type with no short-circuit portion. The above effect has been verified by simulation and will be explained, combined with a second embodiment of the present invention, later with reference to FIG. 7.

A second one of the features is that each of the first short-circuit portion 14 and the second short-circuit portion 16 is arranged between the first feed portion 13 and the second feed portion 15.

More specifically, a distance between the first short-circuit portion 14 and the first feed portion 13 is smaller than a distance between the first feed portion 13 and the second feed portion 15. Besides, a distance between the first short-circuit portion 14 and the second feed portion 15 is smaller than the distance between the first feed portion 13 and the second feed portion 15. That is, the first short-circuit portion 14 is located between the first feed portion 13 and the second feed portion 15, and not very far from a straight line joining the first feed portion 13 and the second feed portion 15.

In other words, the second feed portion 15 is located farther from the first feed portion 13 than from the first short-circuit portion 14, and farther than the first short-circuit portion 14 is from the first feed portion 13.

Then, a distance between the second short-circuit portion 16 and the first short-circuit portion 14 is smaller than a distance between the first short-circuit portion 14 and the second feed portion 15. Besides, a distance between the second short-circuit portion 16 and the second feed portion 15 is smaller than the distance between the first short-circuit portion 14 and the second feed portion 15. That is, the second short-circuit portion 16 is located between the first short-circuit portion 14 and the second feed portion 15, and not very far from a straight line joining the first short-circuit portion 14 and the second feed portion 15.

In other words, the second feed portion 15 is located farther from the first short-circuit portion 14 than from the second short-circuit portion 16, and farther than the second short-circuit portion 16 is from the first short-circuit portion 14.

An arrangement of the first feed portion 13, the first short-circuit portion 14, the second short-circuit portion 16 and the second feed portion 15 along the upper side of the PCB 1 and almost on a single straight line as shown in FIG. 1 is considered as exemplary only as to a positional relationship among the feed portions and the short-circuit portions described above.

The above feed portions and the short-circuit portions may not be arranged on a single straight line as shown in FIG. 1. As long as two short-circuit portions are arranged between two feed portions, an effect of improving isolation may be obtained to greater or lesser degrees. The above effect has been verified by simulation and will be explained, combined with the second embodiment of the present invention, later with reference to FIG. 10.

As shown in FIG. 1, the first antenna element 11 and the second antenna element 12 are formed almost in a same direction (leftwards for this embodiment) near the upper side of the PCB 1. The antenna device 10 may be provided in a small-sized radio apparatus by having the first antenna element 11 and the second antenna element 12 formed almost in the same direction as shown above.

Figure 2:
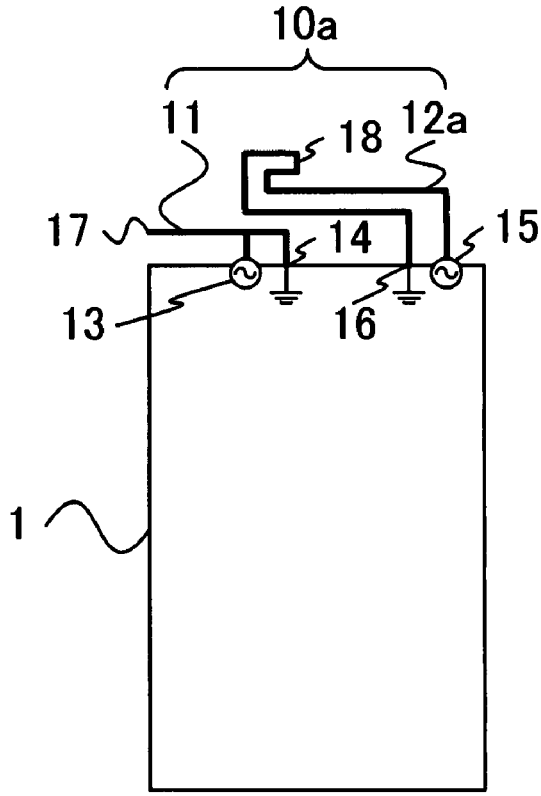
FIG. 2 is a plan view of members including an antenna device modified from the antenna device of the first embodiment, where a shape of the second antenna element is changed.

FIG. 2 is a plan view of members including an antenna device 10*a* of a modification of the first embodiment to show a configuration of and around the antenna device 10*a*. The antenna device 10*a* is arranged near the upper side of the PCB 1, a same as the corresponding one shown in FIG. 1. The antenna device 10*a* has the first antenna element 11 which is a same as the corresponding one shown in FIG. 1, and a second antenna element 12*a*.

The second antenna element 12*a* is configured to be fed at the second feed portion 15 provided on the PCB 1 and is short-circuited to the ground circuit of the PCB 1 at the second short-circuit portion 16 provided on the PCB 1 so as to be grounded, in a same manner as described above with respect to the second antenna element 12.

The second antenna element 12*a* is formed by a round-trip line folded back at a fold portion 18. The first feed portion 13, the first short-circuit portion 14, the second feed portion 15 and the second short-circuit portion 16 are in a same positional relationship as explained with respect to the antenna device 10 as shown in FIG. 1.

The antenna device 10*a* has the first and second features same as the antenna device 10 has, for improving isolation between the first antenna element 11 and the second antenna element 12*a*. Besides, the first antenna element 11 is formed in a way that the open end 17 is directed leftwards and the second antenna element 12*a* is formed in a way that the fold portion 18 is directed rightwards. That is, the first antenna element 11 and the second antenna element 12*a* are formed in a way that the open end 17 and the fold portion 18 are directed to go away from each other.

The first antenna element 11 is configured to be a so-called inverted-F antenna. If the first antenna element 11 is fed, a relatively high voltage is distributed at and around the open end 17. The second antenna element 12*a* is configured to be a folded monopole antenna. If the second antenna element 12*a* is fed, a relatively high voltage is distributed at and around the fold portion 18.

As the open end 17 and the fold portion 18 where relatively high voltages are distributed are directed to go away from each other, a voltage-coupling between the first antenna element 11 and the second antenna element 12*a* may be suppressed, and isolation between the first antenna element 11 and the second antenna element 12*a* may be improved.

Due to limited mounting space of the radio apparatus, it may be difficult to locate the open end 17 of the first antenna element 11 further left to a left side of the PCB 1. In such a case, the first antenna element 11 is formed directed away from the second antenna element 12*a* near the upper side of the PCB 1, and the open end 17 is located near a left end of the upper side of the PCB 1.

Figure 3:
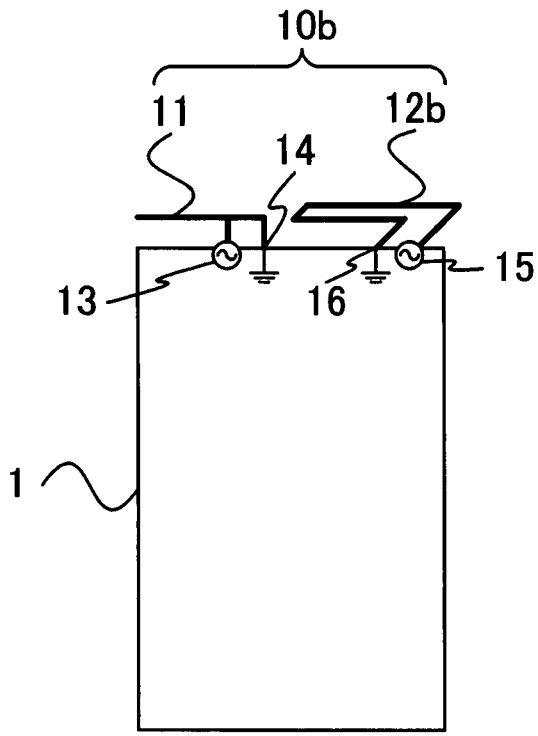
FIG. 3 is a plan view of members including an antenna device modified from the antenna device of the first embodiment, where a relative arrangement of the first antenna element and the second antenna element is changed.

FIG. 3 is a plan view of members including an antenna device 10*b* of another modification of the first embodiment to show a configuration of and around the antenna device 10*b*. The antenna device 10*b* is arranged near the upper side of the PCB 1, the same as shown in FIG. 1. The antenna device 10*b* has the first antenna element 11, the same as shown in FIG. 1, and a second antenna element 12*b*.

The second antenna element 12*b* is configured to be fed at the second feed portion 15 provided on the PCB 1 and is short-circuited to the ground circuit of the PCB 1 at the second short-circuit portion 16 provided on the PCB 1 so as to be grounded, in a same manner as described above with respect to the second antenna element 12. The first feed portion 13, the first short-circuit portion 14, the second feed portion 15 and the second short-circuit portion 16 are in a same positional relationship as explained with respect to the antenna device 10 as shown in FIG. 1.

In order to improve isolation between the first antenna element 11 and the second antenna element 12*b*, the antenna device 10*b* has the first and second features which are same as the antenna device 10 has. Besides, a portion of the first antenna element 11 near the first feed portion 13 and a portion of the second antenna element 12*b* near the second feed portion 15 are formed almost perpendicular to each other.

As the portion of the first antenna element 11 near the first feed portion 13 and the portion of the second antenna element 12*b* near the second feed portion 15 are formed almost perpendicular to each other, a current-coupling between the first antenna element 11 and the second antenna element 12*b* may be suppressed, and the isolation between the first antenna element 11 and the second antenna element 12*b* may be improved. The antenna device 10*a* shown in FIG. 2 may also be modified in a same way as the antenna device 10 is modified to be the antenna device 10*b*.

According to the first embodiment of the present invention described above, the antenna device having plural antenna elements may be configured to select the positional relationship of the feed portions and the short-circuit portions and configured to select the positional relationship between the antenna elements associated with the high-and-low voltage or current distribution for improving the isolation between the antenna elements.

Figure 4:
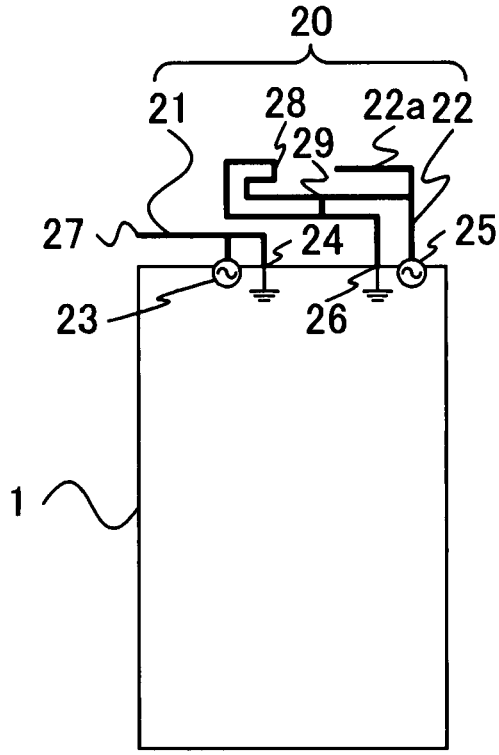
FIG. 4 is a plan view of members including an antenna device of a second embodiment of the present invention, having a first antenna element of an inverted-F type and a second antenna element.

A second embodiment of the present invention will be described with reference to FIGS. 4-11. FIG. 4 is a plan view of members including an antenna device 20 of the second embodiment to show a configuration of and around the antenna device 20. The antenna device 20 is arranged near the upper side of the PCB 1, the same as shown in FIG. 1 of the first embodiment. The antenna device 20 has a first antenna element 21, a second antenna element 22 and a branch element 22*a* which branches off from the second antenna element 22.

The first antenna element 21 is configured to be fed at a first feed portion 23 provided on the PCB 1 and is short-circuited to a ground circuit of the PCB 1 at a first short-circuit portion 24 provided on the PCB 1 so as to be grounded. The first antenna element 21 has a tip which is an open end 27. Although the first antenna element 21 is a same as the first antenna element 11 of the first embodiment, each portion of the first antenna element 21 is given an updated reference numeral.

The second antenna element 22 is configured to be fed at the second feed portion 25 provided on the PCB 1 and is short-circuited to the ground circuit of the PCB 1 at the second short-circuit portion 26 provided on the PCB 1 so as to be grounded.

The second antenna element 22 is formed by a round-trip line folded back at a fold portion 28, having a way forward and a way back short-circuited at a bridge 29. The second antenna element 22 is formed by a same element as the second antenna element 12*a* (each portion is given an updated reference numeral, though) to which the bridge 29 is added and from which the branch element 22*a* branches off.

The first feed portion 23, the first short-circuit portion 24, the second feed portion 25 and the second short-circuit portion 26 are in a same positional relationship as explained with respect to the first feed portion 13, the first short-circuit portion 14, the second feed portion 15 and the second short-circuit portion 16 of the antenna device 10*a* as shown in FIG. 2.

In order to improve isolation between the first antenna element 21 and the second antenna element 22, the antenna device 20 as configured above has the first and second features which are same as the antenna device 10 or 10*a* of the first embodiment has.

As the open end 27 and the fold portion 28 where relatively high voltages are distributed are directed to go away from each other, a voltage-coupling between the first antenna element 21 and the second antenna element 22 may be suppressed, and isolation between the first antenna element 21 and the second antenna element 22 may be improved.

The antenna device 20 has the branch element 22*a* branch off for being multi-resonant and adds the bridge 29 for improving impedance matching. Meanwhile, having the features of the configuration in common with the antenna device 10*a*, the antenna device 20 may produce a same effect as the antenna device 10*a* does.

An effect of the first feature of the antenna device 20 has been estimated by simulation, and a result of the simulation will be explained with reference to FIGS. 5-7.

Figure 5:
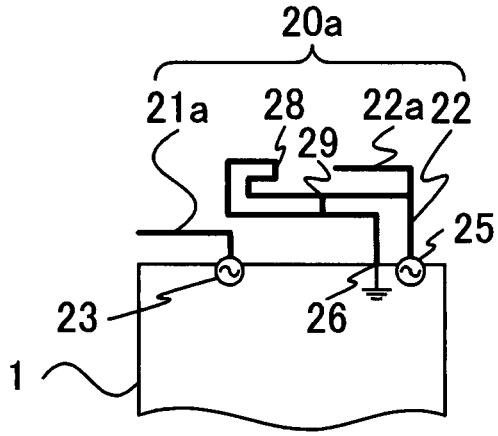
FIG. 5 is a plan view of members including an antenna device of a modification of the second embodiment, having a first antenna element of an open ended monopole type.

FIG. 5 is a plan view of members including an antenna device 20*a* modified from the antenna device 20, where the first antenna element 21 of an inverted-F type is replaced with a first antenna element 21*a* of an open-ended monopole type to be compared with. Each of portions shown in FIG. 5 is a same as the corresponding one shown in FIG. 4, except for the first antenna element 21*a* (only an upper portion of the PCB 1 is shown in FIG. 5).

Figure 6:
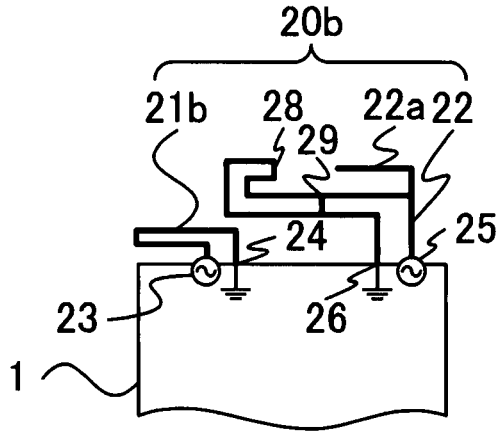
FIG. 6 is a plan view of members including an antenna device of a modification of the second embodiment, having a first antenna element of a folded monopole type.

FIG. 6 is a plan view of members including an antenna device 20*b* modified from the antenna device 20, where the first antenna element 21 of an inverted-F type is replaced with a first antenna element 21*b* of a folded monopole type to be compared with. Each of portions shown in FIG. 6 is a same as the corresponding one shown in FIG. 4, except for the first antenna element 21*b* (only an upper portion of the PCB 1 is shown in FIG. 5).

Figure 7:
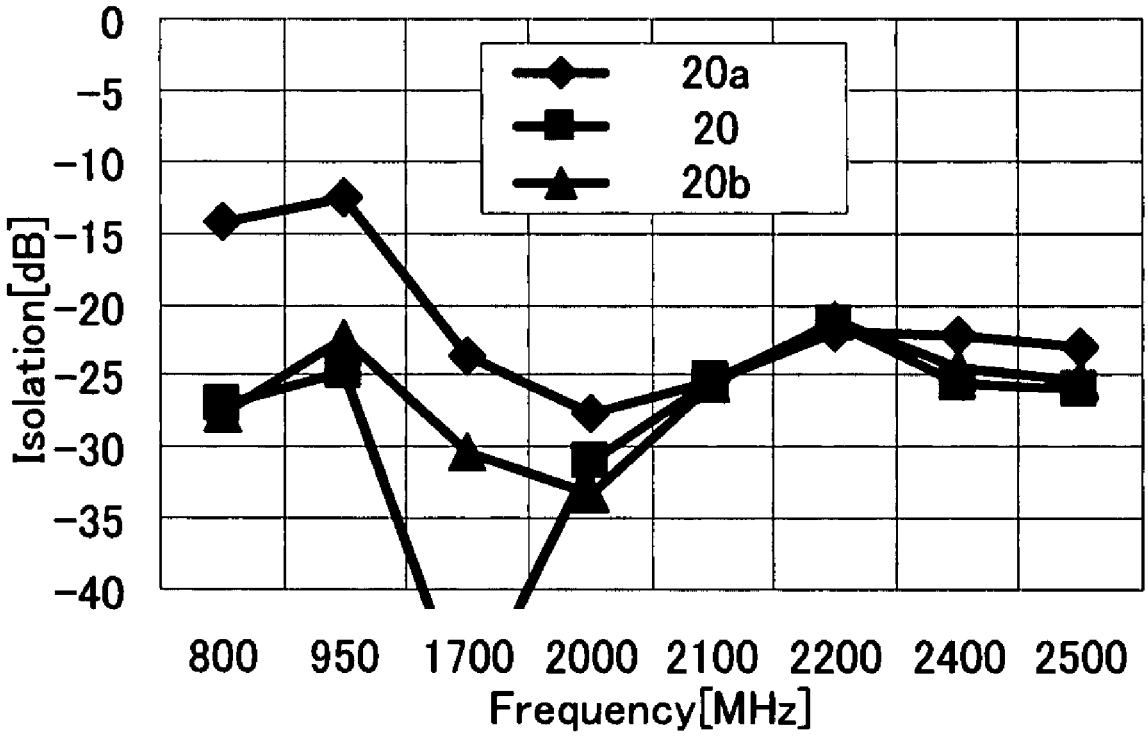
FIG. 7 is a line chart of isolation vs. frequency characteristics of the antenna devices shown in FIGS. 4, 5 and 6, estimated by simulation.

FIG. 7 is a line chart of isolation vs. frequency characteristics of the antenna devices 20, 20*a* and 20*b* shown in FIGS. 4, 5 and 6, respectively, estimated by simulation. FIG. 7 has a horizontal axis representing the frequency in megahertz (MHz) and a vertical axis representing the isolation by negative values in decibel (dB). Note that as the isolation is represented by negative values and a greater or less relationship is algebraically defined, greater isolation means less adequate isolation hereafter. It has been assumed that the first feed portion 23 is located 20 millimeters (mm) from the left end of the upper side of the PCB 1 in FIGS. 4-6.

For the second embodiment, frequency ranges assigned to, e.g., mobile phones or Bluetooth are of interest and other frequency ranges are omitted from the horizontal axis in FIG. 7 (and also in FIGS. 10, 11 and 14 which are referred to later for the second and third embodiments). As to a resonant frequency of each of the antenna elements, it has been assumed, e.g., that the first antenna element 21, 21*a* or 21*b* is given a frequency in a 2.4 gigahertz (GHz) band (Bluetooth), the second antenna element 22 in a 800 MHz band (mobile phones) and the branch element 22*a* in a 1.7 GHz band (third generation (3G) mobile phones).

In FIG. 7, a series of line segments joining diamond-shaped plots represents the characteristic of the antenna device 20*a* (including the first antenna element 21*a* of the open-ended monopole type) shown in FIG. 5. A series of line segments joining square plots represents the characteristic of the antenna device 20 (including the first antenna element 21 of the inverted-F type) shown in FIG. 4. A series of line segments joining triangular plots represents the characteristic of the antenna device 20*b* (including the first antenna element 21*b* of the folded monopole type) shown in FIG. 6.

As shown in FIG. 7, the isolation characteristic of the antenna device 20 or 20*b* having the first antenna element 21 or 21*b*, respectively, grounded at the first short-circuit portion 24 is better than the isolation characteristic of the antenna device 20*a* having the first antenna element 21*a* with no short-circuit portion, particularly in the 800 MHz band for the mobile phones.

If the isolation is required to be no greater than −20 dB in FIG. 7, e.g., the antenna device 20*a* (the diamond-shaped plots) does not meet the above requirement at lower frequencies, and the antenna device 20 (the square plots) or 20*b* (the triangular plots) meets the above requirement in each of the frequency bands. Thus, it is shown that the antenna element having the short-circuit portion (the first feature) may contribute to improvement of the isolation.

Figure 8:
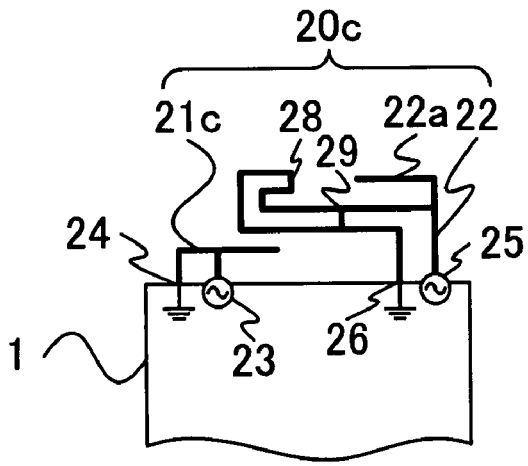
FIG. 8 is a plan view of members including an antenna device of a modification of the second embodiment, having a first antenna element of an inverted-F type directed opposite the second antenna element.

An effect of the second feature of the antenna device 20 has been estimated by simulation, and a result of the simulation will be explained with reference to FIGS. 8-10. FIG. 8 is a plan view of members including an antenna device 20*c* modified from the antenna device 20, where the first antenna element 21 of the inverted-F type is replaced with a first antenna element 21*c* of an inverted-F type directed differently to be compared with.

Each of portions shown in FIG. 8 is a same as the corresponding one shown in FIG. 4, except for the first antenna element 21*c* (only an upper portion of the PCB 1 is shown in FIG. 8). In FIG. 8, the first feed portion 23 is located closer to the second antenna element 22 than the first short-circuit portion 24 is. The first antenna element 21*c* is arranged in a way that the open end is directed opposite the second antenna element 22.

Figure 9:
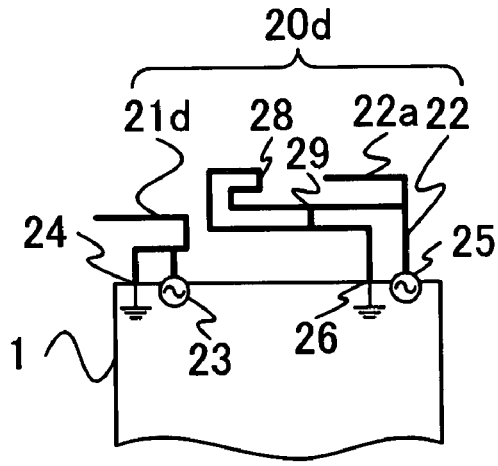
FIG. 9 is a plan view of members including an antenna device of a modification of the second embodiment, having a first antenna element of an inverted-F type directed to go away from the second antenna element.

FIG. 9 is a plan view of members including an antenna device 20*d* modified from the antenna device 20, where the first antenna element 21 of the inverted-F type is replaced with a first antenna element 21*d* of an inverted-F type directed differently to be compared with.

Each of portions shown in FIG. 9 is a same as the corresponding one shown in FIG. 4, except for the first antenna element 21*d* (only an upper portion of the PCB 1 is shown in FIG. 9). In FIG. 9, the first feed portion 23 is located closer to the second antenna element 22 than the first short-circuit portion 24 is. The first antenna element 21*d* is arranged in a way that the open end is directed to go away from the second antenna element 22.

Figure 10:
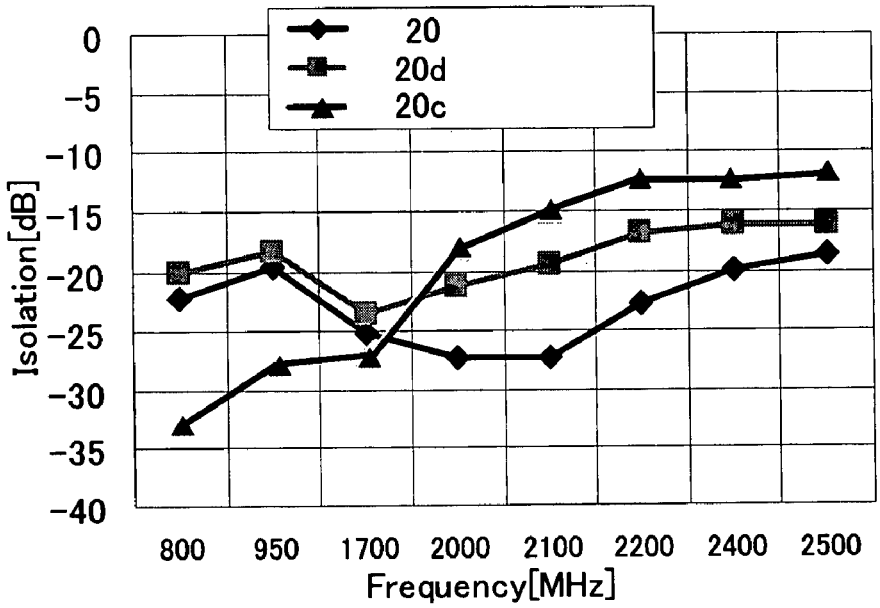
FIG. 10 is a line chart of isolation vs. frequency characteristics of the antenna devices shown in FIGS. 4, 8 and 9, estimated by simulation.

FIG. 10 is a line chart of isolation vs. frequency characteristics of the antenna devices 20, 20*c* and 20*d* shown in FIGS. 4, 8 and 9, respectively, estimated by simulation. FIG. 10 has the horizontal axis and the vertical axis in common with FIG. 7. It has been assumed that the first feed portion 23 is located 10 mm from the left end of the upper side of the PCB 1 in FIGS. 4, 8 and 9.

In FIG. 10, a series of line segments joining diamond-shaped plots represents the characteristic of the antenna device 20 shown in FIG. 4. As shown in FIG. 4, the short-circuit portion 24 is located in a range between the first feed portion 23 and the second feed portion 25, and the open end 27 is directed to go away from the second antenna element 22.

In FIG. 10, a series of line segments joining square plots represents the characteristic of the antenna device 20*d* shown in FIG. 9. As shown in FIG. 9, the short-circuit portion 24 is located out of the range between the first feed portion 23 and the second feed portion 25 (near the end of the upper side of the PCB 1), and the open end of the first antenna element 21*d* is directed to go away from the second antenna element 22.

In FIG. 10, a series of line segments joining triangular plots represents the characteristic of the antenna device 20*c* shown in FIG. 8. As shown in FIG. 8, the open end of the first antenna element 21*c* is directed opposite the second antenna element 22.

If the isolation is required to be no greater than −20 dB in FIG. 10, e.g., the antenna device 20*c* (the triangular plots) or 20*d* (the square plots), having the first short-circuit portion 24 out of the range between the first feed portion 23 and the second feed portion 25, does not meet the above requirement at relatively lower or higher frequencies.

Meanwhile, the antenna device 20 (the diamond-shaped plots) having the first short-circuit portion in the range between the first feed portion 23 and the second feed portion 25 and having the open end 27 directed to go away from the second antenna element 22 meets the above requirement in most of the frequency bands shown in FIG. 10.

In the above description, the square plots shown in FIG. 7 and the diamond-shaped plots shown in FIG. 10 both show the isolation characteristics of the antenna device 20 shown in FIG. 4, which are different though depending upon the location of the first feed portion 23 (the distance from the left end of the upper side of the PCB 1).

Thus, the isolation characteristic of the antenna device 20 has been estimated by simulation given the location of the first feed portion 23 (the distance from an end of the upper side of the PCB 1 farther from the second antenna element 22, i.e., the left end) as a variable parameter.

Figure 11:
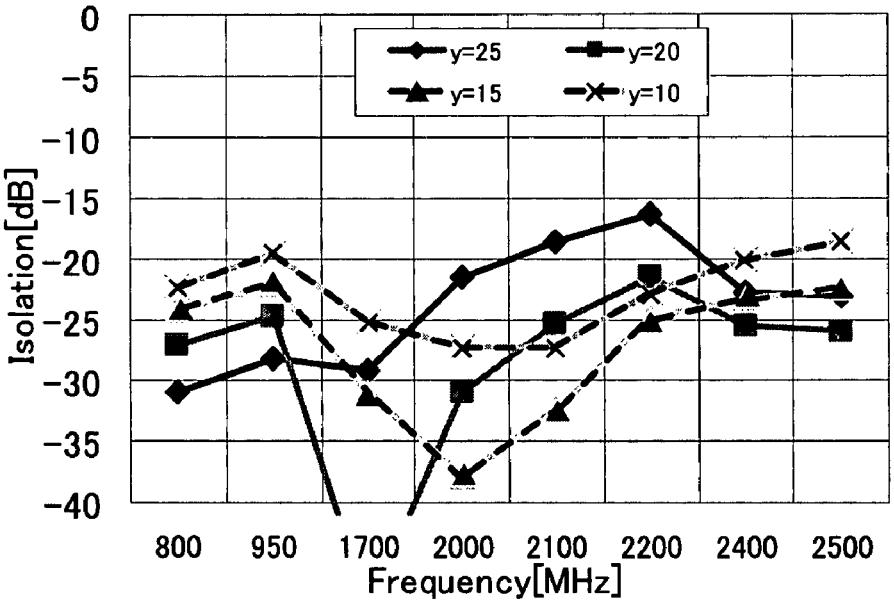
FIG. 11 is a line chart of isolation vs. frequency characteristics of the antenna device of the second embodiment given a location of a feed portion of the first antenna element as a variable parameter.

FIG. 11 is a line chart to show a result of the above simulation. FIG. 11 has the horizontal axis and the vertical axis in common with FIG. 7. The distance between the first feed portion 23 and the left end of the upper side of the PCB 1 is given as the parameter y (in mm). It is assumed that the first antenna element 21 has a resonant frequency of 2.5 GHz. In FIG. 11, diamond-shaped plots, square plots, triangular plots and x-plots represent y=25 mm, 20 mm, 15 mm and 10 mm, respectively.

As shown in FIG. 11, the antenna device 20 meets the required value of the isolation (−20 dB) in every frequency band shown in FIG. 11 in a case of y=20 mm (equivalent to one-sixth wavelength of the resonant frequency of the first antenna element 21) or y=15 mm (equivalent to one-eighth wavelength of the resonant frequency of the first antenna element 21).

That is, the antenna device 20 may meet the above required value of the isolation by setting the distance between the first feed portion 23 and the left end of the upper side of the PCB 1 to be no less than one-eighth wavelength and no greater than one-sixth wavelength of the resonant frequency of the first antenna element 21, and by having the first antenna element 21 directed from the first feed portion 23 to the left end of the upper side of the PCB 1.

The antenna device 20 of the second embodiment may be modified in a same way as shown in FIG. 3 of the first embodiment, where a portion of the first antenna element 21 near the first feed portion 23 and a portion of the second antenna element 22 near the second feed portion 25 are almost perpendicular to each other. In that case, a current coupling between the first antenna element 21 and the second antenna element 22 may be suppressed and the isolation may be improved.

According to the second embodiment of the present invention described above, the antenna device having plural antenna elements may be configured to select the positional relationship of the feed portions and the short-circuit portions and to select the positional relationship between the antenna elements associated with the high-and-low voltage or current distribution for improving the isolation between the antenna elements, in a case where the antenna elements are modified for multiple resonance or impedance matching.

Figure 12:
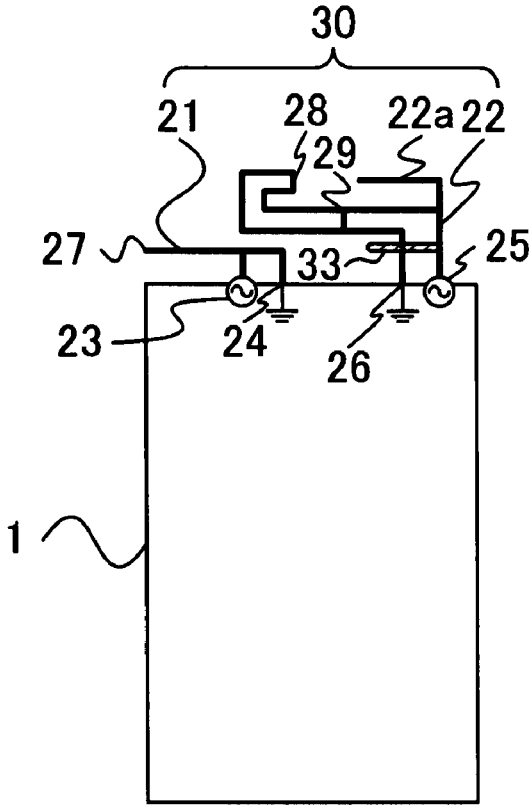
FIG. 12 is a plan view of members including an antenna device of a third embodiment of the present invention, formed by the antenna device of the second embodiment and a third antenna element added thereto.

A third embodiment of the present invention will be described with reference to FIGS. 12-14. FIG. 12 is a plan view of members including an antenna device 30 of the third embodiment to show a configuration of and around the antenna device 30. The antenna device 30 is arranged near the upper side of the PCB 1, the same as shown in FIG. 1 of the first embodiment.

The antenna device 30 is formed by the antenna device 20 of the second embodiment and a third antenna element 33 added to the antenna device 20. Thus, each portion of the antenna device 30 except for the antenna element 33 is a same as the corresponding one of the antenna device 20 given the same reference numeral as shown in FIG. 4.

The third antenna element 33 branches off from the second antenna element 22 near the second feed portion 25, and reaches an open end. The third antenna element 33 is arranged farther to the PCB 1 than the portion of the second antenna element 22 connected to the second short-circuit portion 26 is. In FIG. 12, the third antenna element 33 indicated by hatching is drawn on a back side of the portion of the second antenna element 22 connected to the second short-circuit portion 26 so that the above positional relationship is shown.

Figure 13:
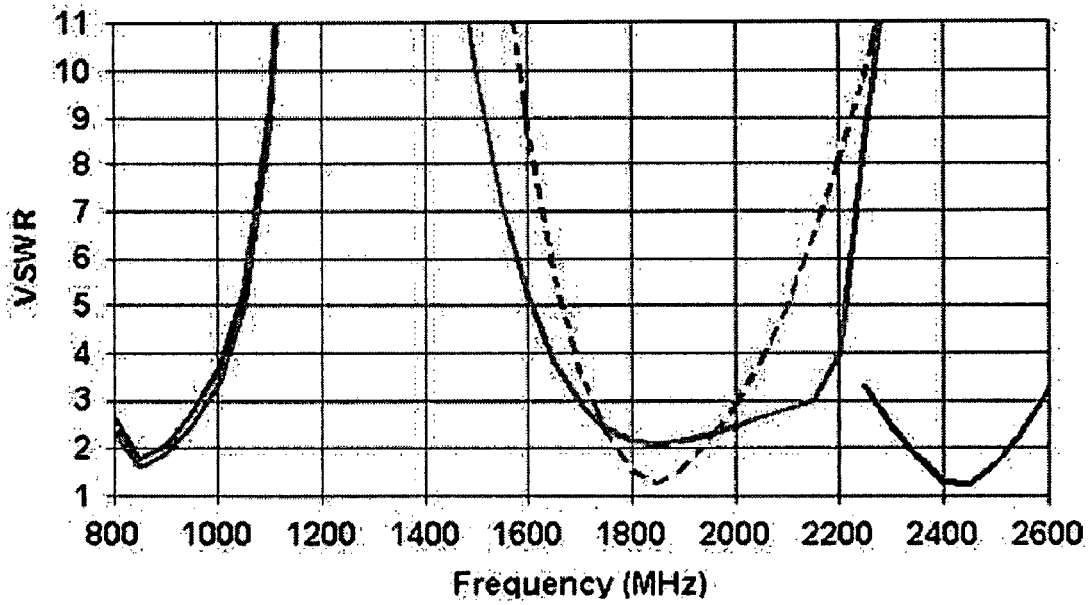
FIG. 13 is a chart of a voltage standing wave ratio (VSWR) vs. frequency characteristic of the antenna device of the third embodiment estimated by simulation in comparison with the characteristic of the antenna device of the second embodiment.

FIG. 13 is a chart of a voltage standing wave ratio (VSWR) vs. frequency characteristic of the antenna device 30 estimated by simulation in comparison with the characteristic of the antenna device 20 of the second embodiment. FIG. 13 has a horizontal axis representing the frequency in MHz and a vertical axis representing the VSWR.

For the third embodiment, the frequency ranges assigned to, e.g., mobile phones or Bluetooth are of interest as for the second embodiment. As to a resonant frequency of each of the antenna elements, it has been assumed, e.g., that the first antenna element 21 is given a frequency in a 2.4 gigahertz (GHz) band (Bluetooth), the second antenna element 22 in a 800 MHz band (mobile phones), the branch element 22*a* in a 1.7 GHz band (3G mobile phones), and the third antenna element 33 in a 2.1 GHz band (3G mobile phones).

In FIG. 13, a curve on a left side (in the 800 MHz band) represents a resonance characteristic of the second antenna element 22. A solid curve on a slightly right side of a middle part (around 1.8 GHz) represents a combination of resonance characteristics of the branch element 22*a* and the third antenna element 33. A dashed curve on a slightly right side of a middle part (around 1.9 GHz) represents a resonance characteristic of the branch element 22*a* alone (to which the third antenna element 33 is not added yet). A curve on a right side (around 2.4 GHz) represents a resonance characteristic of the first antenna element 21.

The curves on the left and right sides of FIG. 13 both represent the resonance characteristics which are common to the antenna device 20 of the second embodiment and the antenna device 30 of the third embodiment. The solid curve on the slightly right side of the middle part represents the resonance characteristic of the antenna device 30, and the dashed curve represents the resonance characteristic of the antenna device 20 of the second embodiment.

As the VSWR of the dashed curve around 1.8 GHz values no less than 5 in the 2.1 GHz band, the antenna device 20 of the second embodiment is not suitable to be used in the 2.1 GHz band. Meanwhile, as the VSWR of the solid curve around 1.9 GHz values almost no greater than 3 in the 2.1 GHz band, the antenna device 30 is suitable to be used in the 2.1 GHz band. Development of multiple resonance by adding the third antenna element 33 to the antenna device 20 of the second embodiment has produced the improvement described above.

Figure 14:
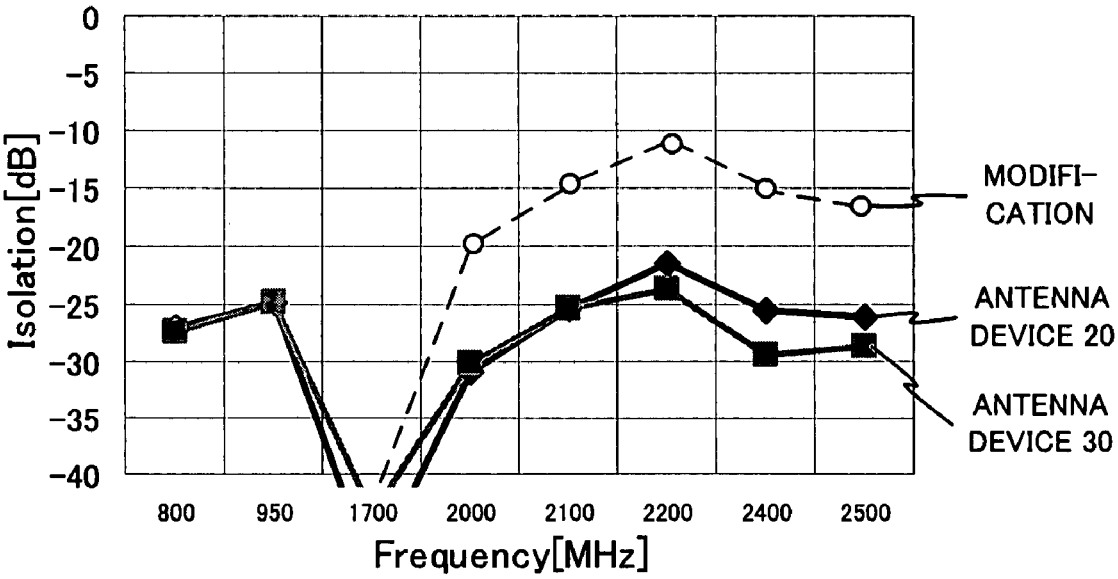

FIG. 14 is a line chart of isolation vs. frequency characteristic of the antenna device 30 estimated by simulation in comparison with the characteristic of other antenna device configurations. FIG. 14 has the horizontal axis and the vertical axis in common with FIG. 7. In FIG. 14, a series of line segments joining square plots represent the characteristic of the antenna device 30. A series of line segments joining diamond-shaped plots represent the characteristic of the antenna device 20 of the second embodiment.

In FIG. 14, a series of line segments joining circular plots represent the characteristic of a modification of the antenna device 30, which is formed in a way that the third antenna element 33 is arranged closer to the PCB 1 than the portion of the second antenna element 22 connected to the second short-circuit portion 26.

As shown in FIG. 14, the antenna device 30 shows the isolation to be no greater than −20 dB in each of the frequency bands, and to be better than the isolation of the antenna device 20 at 2.2 GHz and above. Meanwhile, the above modification of the antenna device 30 shows isolation to be inferior to the isolation of the antenna device 30 by no less than 10 dB.

As, in the configuration of the antenna device 30, the third antenna element 33 is located farther to the PCB 1 than the portion of the second antenna element 22 connected to the second short-circuit portion 26 is, image currents produced after the third antenna element 33 is excited are distributed rather on the second antenna element 22 than on the ground circuit of the PCB 1. As a result, influence of the image currents on the first antenna element 21 through the ground circuit of the PCB 1 and the first feed portion 23 may be suppressed.

In the configuration of the above modification of the antenna device 30 though, as the third antenna element 33 is located closer to the PCB 1 than the portion of the second antenna element 22 connected to the second short-circuit portion 26 is, the image currents produced after the third antenna element 33 is excited are distributed rather on the ground circuit of the PCB 1 than on the second antenna element 22. As a result, the image currents may easily affect the first antenna element 21 through the ground circuit of the PCB 1 and the first feed portion 23, and may cause the isolation characteristic to be inferior to the isolation characteristic of the antenna device 30.

As another example of developing multiple resonance by a configuration other than the antenna device 30, a parasitic element may be added to the antenna device 20 of the second embodiment. In that case, a configuration may be generally considered where a parasitic element having one end grounded is arranged near the second antenna element 25 for convenience of implementation. In the above configuration, however, image currents produced after the parasitic element is excited are distributed on the ground circuit of the PCB 1, and may cause the isolation characteristic to be inferior to the isolation characteristic of the antenna device 30, too.

In the configuration of the antenna device 30 shown in FIG. 12, it is desirable for improvement of the characteristic to pay attention to following two things. Firstly, select a positional relationship among the elements so that neither the branch element 22*a* nor the third antenna element 33 is located too close to the ground circuit of the PCB 1. If the distance between the branch element 22*a* and the PCB 1, or between the third antenna element 33 and the PCB 1 is small, impedance at the second feed portion 25 drops so that the image currents are likely to be distributed on the ground circuit of the PCB 1, thus causing the isolation characteristic to be degraded as described above.

Secondly, shorten a portion of the second antenna element 22 including the fold portion 28, where both the way forward and the way back are turned, as much as possible. If the above portion is long, lines before and behind the turn of both the way forward and the way back are coupled to each other, thus causing a condition similar to loading a lumped constant element.

Then, a frequency of third harmonics of the 800 MHz band may fall below a theoretical value, and in a case where, e.g., the first antenna element 21 is located close, the above third harmonics may interfere with the first antenna element 21. In order to avoid such interference, it is desirable to shorten the portion where both the way forward and the way back are turned as much as possible so as keep the frequency of the third harmonics from falling.

As shown in FIG. 1, the antenna device 30 may be provided in a small-sized radio apparatus by having the first antenna element 21 and the second antenna element 22 formed almost in a same direction. As the open end 27 and the fold portion 28 where relatively high voltages are distributed are directed to go away from each other, a voltage-coupling between the first antenna element 21 and the second antenna element 22 may be suppressed, and isolation between the first antenna element 21 and the second antenna element 22 may be improved.

The first antenna element 21 is formed directed away from the second antenna element 22 near the upper side of the PCB 1, while the open end 27 may be located near a left end of the upper side of the PCB 1. In a same way as described with respect to the second embodiment, the antenna device 30 may improve the isolation by setting the distance between the first feed portion 23 and the left end of the upper side of the PCB 1 to be no less than one-eighth wavelength and no greater than one-sixth wavelength of the resonant frequency of the first antenna element 21, and by having the first antenna element 21 directed from the first feed portion 23 to the left end of the upper side of the PCB 1.

In a same way as shown in FIG. 3 of the first embodiment, the antenna device 30 may be modified in a way that a portion of the first antenna element 21 near the first feed portion 23 and a portion of the second antenna element 22 near the second feed portion 25 are formed almost perpendicular to each other. In that case, a current-coupling between the first antenna element 21 and the second antenna element 22 may be suppressed, and the isolation between the first antenna element 21 and the second antenna element 22 may be improved.

According to the third embodiment of the present invention described above, multiple resonance of the antenna device may further be developed, and the isolation between the antenna elements may be improved.

In the above description of the embodiments, the shapes, the configurations and the connections of the antenna devices, the frequency values, etc. are considered as exemplary only, and thus may be variously modified within the scope of the present invention.

The particular hardware or software implementation of the present invention may be varied while still remaining within the scope of the present invention. It is therefore to be understood that within the scope of the appended claims and their equivalents, the invention may be practiced otherwise than as specifically described herein.

What is claimed is:

1. An antenna device, provided in a radio apparatus having a printed circuit board and including a first system and a second system which are different from each other, the antenna device comprising:

a first antenna element configured to be fed at a first feed portion provided on the printed circuit board, and configured to be grounded at a first short-circuit portion provided on the printed circuit board; and a second antenna element configured to be fed at a second feed portion provided on the printed circuit board, and configured to be grounded at a second short-circuit portion provided on the printed circuit board, wherein:

the first feed portion and the second feed portion are connected to the first system and the second system, respectively and separately, the second feed portion is located farther from the first feed portion than from the first short-circuit portion, the second feed portion is located farther than the first short-circuit portion is from the first feed portion, the second feed portion is located farther from the first short-circuit portion than from the second short-circuit portion, and the second feed portion is located farther than the second short-circuit portion is from the first short-circuit portion.

2. The antenna device of claim 1, wherein the first antenna element and the second antenna element are formed almost in a same direction near a side of the printed circuit board.

3. The antenna device of claim 1, wherein the first antenna element and the second antenna element are formed such that a portion of the first antenna element where a relatively high voltage is distributed if the first antenna element is fed and a portion of the second antenna element where a relatively high voltage is distributed if the second antenna element is fed are directed to go away from each other.

4. The antenna device of claim 1, wherein the first antenna element is formed in a direction to go away from the second antenna element near a side of the printed circuit board, and the first antenna element is arranged such that a portion of the first antenna element where a relatively high voltage is distributed if the first antenna element is fed is located near an end of the side of the printed circuit board.

5. The antenna device of claim 1, wherein:

the first feed portion is located near a side of the printed circuit board, the first feed portion is located at a distance that is no less than one-eighth wavelength of a resonant frequency of the first antenna element and no greater than one-sixth wavelength of the resonant frequency, from an end of the side that is farther from the second antenna element, and the first antenna element is formed in a direction extending from the first feed portion to the end of the side that is farther from the second antenna element.

6. The antenna device of claim 1, wherein the first antenna element and the second antenna element are formed such that a portion of the first antenna element close to the first feed portion and a portion of the second antenna element close to the second feed portion are almost perpendicular to each other.

7. An antenna device, provided in a radio apparatus having a printed circuit board and including a first system and a second system which are different from each other, the antenna device comprising:

a first antenna element configured to be fed at a first feed portion provided on the printed circuit board, and configured to be grounded at a first short-circuit portion provided on the printed circuit board, the first antenna element being arranged close to a side of the printed circuit board;

a second antenna element configured to be fed at a second feed portion provided on the printed circuit board, and configured to be grounded at a second short-circuit portion provided on the printed circuit board, the second antenna element being arranged close to the side of the printed circuit board; and a third antenna element branching off from the second antenna element near the second feed portion, the third antenna element being open-ended, and the third antenna element being arranged farther than a portion of the second antenna element connected to the second short-circuit portion is from the printed circuit board, wherein:

the first feed portion and the second feed portion are connected to the first system and the second system, respectively and separately, the second feed portion is located farther from the first feed portion than from the first short-circuit portion, the second feed portion is located farther than the first short-circuit portion is from the first feed portion, the second feed portion is located farther from the first short-circuit portion than from the second short-circuit portion, and the second feed portion is located farther than the second short-circuit portion is from the first short-circuit portion.

8. The antenna device of claim 7, wherein the first antenna element and the second antenna element are formed almost in a same direction near the side of the printed circuit board.

9. The antenna device of claim 7, wherein the first antenna element and the second antenna element are formed such that a portion of the first antenna element where a relatively high voltage is distributed if the first antenna element is fed and a portion of the second antenna element where a relatively high voltage is distributed if the second antenna element is fed are directed to go away from each other.

10. The antenna device of claim 7, wherein the first antenna element is formed in a direction to go away from the second antenna element near the side of the printed circuit board, and the first antenna element is arranged such that a portion of the first antenna element where a relatively high voltage is distributed if the first antenna element is fed is located near an end of the side of the printed circuit board.

11. The antenna device of claim 7, wherein:

the first feed portion is located near the side of the printed circuit board, the first feed portion is located at a distance that is no less than one-eighth wavelength of a resonant frequency of the first antenna element and no greater than one-sixth wavelength of the resonant frequency, from an end of the side that is farther from the second antenna element, and the first antenna element is formed in a direction extending from the first feed portion to the end of the side that is farther from the second antenna element.

12. The antenna device of claim 7, wherein the first antenna element and the second antenna element are formed such that a portion of the first antenna element close to the first feed portion and a portion of the second antenna element close to the second feed portion are almost perpendicular to each other.

* * * * *